US012543854B2

(12) United States Patent
Lee et al.

(10) Patent No.: US 12,543,854 B2
(45) Date of Patent: Feb. 10, 2026

(54) SLIDING DEVICE

(71) Applicant: SEGOS CO., LTD., Incheon (KR)

(72) Inventors: Doo Myun Lee, Incheon (KR); Duc Hoi Kim, Incheon (KR); Ro Hee Lee, Incheon (KR); Sai Ryun Kim, Incheon (KR); Byeol Kim, Seoul (KR)

(73) Assignee: SEGOS CO., LTD., Incheon (KR)

( * ) Notice: Subject to any disclaimer, the term of this patent is extended or adjusted under 35 U.S.C. 154(b) by 261 days.

(21) Appl. No.: 18/032,690

(22) PCT Filed: Oct. 21, 2021

(86) PCT No.: PCT/KR2021/014777

§ 371 (c)(1),
(2) Date: Apr. 19, 2023

(87) PCT Pub. No.: WO2022/092696

PCT Pub. Date: May 5, 2022

(65) Prior Publication Data

US 2023/0380593 A1 Nov. 30, 2023

(30) Foreign Application Priority Data

Oct. 27, 2020 (KR) ..... 10-2020-0140450

(51) Int. Cl.
*A47B 88/487* (2017.01)

(52) U.S. Cl.
CPC .... *A47B 88/487* (2017.01); *A47B 2210/0035* (2013.01)

(58) Field of Classification Search
CPC ..... A47B 88/487; A47B 88/493; A47B 88/10; A47B 88/14; A47B 2210/0002; A47B 2210/0032; A47B 2210/0035
See application file for complete search history.

(56) References Cited

U.S. PATENT DOCUMENTS 4,564,247 A * 1/1986 Knoop ..... F16C 29/04 384/19
5,209,572 A 5/1993 Jordan
5,344,228 A 9/1994 Kovarik et al.
(Continued)

FOREIGN PATENT DOCUMENTS

DE 3008549 A1 * 9/1981 ..... A47B 88/487
EP 1277422 A1 * 1/2003 ..... A47B 88/493
(Continued)

OTHER PUBLICATIONS

Translation KR100854631B1, 5 pages (Year: 2008).*
(Continued)

*Primary Examiner* — Andrew Roersma
(74) *Attorney, Agent, or Firm* — Sughrue Mion, PLLC

(57) ABSTRACT

An embodiment of the present invention provides a sliding device comprising: a first rail member which is open at one side surface thereof; a second rail member which slides on the first rail member and is open at one side surface thereof; and ball members which are disposed between the first rail member and the second rail member such that at least three ball members are provided as seen in a cross section, wherein the first rail member and the second rail member are arranged to be engaged with each other through the open side surfaces.

12 Claims, 11 Drawing Sheets

(56) References Cited

U.S. PATENT DOCUMENTS

| | | | | |
|---|---|---|---|---|
| 5,417,489 | A * | 5/1995 | Compagnucci | A47B 88/493 312/334.44 |
| 6,132,020 | A | 10/2000 | Schael et al. | |
| 6,848,760 | B2 | 2/2005 | Thomas et al. | |
| 9,095,213 | B2 | 8/2015 | Park et al. | |
| 9,427,084 | B2 * | 8/2016 | Park | A47B 88/493 |
| 10,420,421 | B2 | 9/2019 | Kim et al. | |
| 2003/0173880 | A1 | 9/2003 | Thomas et al. | |
| 2009/0074334 | A1 * | 3/2009 | Juan | A47B 88/493 384/19 |
| 2011/0241515 | A1 | 10/2011 | Park et al. | |
| 2018/0084911 | A1 | 3/2018 | Kim et al. | |
| 2020/0245766 | A1 * | 8/2020 | Rechberg | A47B 88/493 |

FOREIGN PATENT DOCUMENTS

| | | | | |
|---|---|---|---|---|
| EP | 2 218 609 | A1 | 8/2010 | |
| GB | 2453326 | A * | 4/2009 | A47B 88/10 |
| JP | 59-118820 | U | 8/1984 | |
| JP | 06-54726 | A | 3/1994 | |
| JP | 2012-501787 | A | 1/2012 | |
| JP | 5286080 | B2 | 9/2013 | |
| KR | 20080050648 | A * | 6/2008 | A47B 88/493 |
| KR | 10-0854631 | B1 | 8/2008 | |
| KR | 20-0452662 | Y1 | 3/2011 | |
| KR | 10-1784808 | B1 | 10/2017 | |
| WO | 2007/125745 | A1 | 11/2007 | |

OTHER PUBLICATIONS

Translation WO2007125745A1, 8 pages (Year: 2007).*

Extended European Search Report issued Mar. 15, 2024 in European Application No. 21886690.3.

International Search Report for PCT/KR2021/014777, dated Feb. 11, 2022.

* cited by examiner ( a )

( b )

( a )

( b )

SLIDING DEVICE

CROSS REFERENCE TO RELATED APPLICATIONS

This application is a National Stage of International Application No. PCT/KR2021/014777 filed Oct. 21, 2021, claiming priority based on Korean Patent Application No. 10-2020-0140450 filed Oct. 27, 2020, the entire disclosures of which are incorporated herein by reference.

TECHNICAL FIELD

The present invention relates to a sliding device, and more specifically, to a sliding device having a two-stage rail structure and improved tilting safety against a load.

BACKGROUND ART

Generally, drawer assemblies are coupled to and installed on the mounting structures, such as refrigerators, dishwashers, ovens, drawers, and the like, to take out or store objects.

Sliding devices are provided in such drawer assemblies to facilitate withdrawal of the drawers from the mounting structures and return them to their original positions. In addition, the sliding devices may include rolling means in the form of of balls or rollers, and thus the sliding devices can move more smoothly to improve user's comfort when the sliding devices slide.

Typically, the sliding device includes a fixed rail fixed to a wall surface of a drawer installation space and one or more moving rails slidably installed with respect to the fixed rail. That is, such sliding devices for guiding the drawers are divided into, for example, bi-fold and tri-fold type sliding devices. Among them, in the case of the bi-fold type sliding device, a fixing rail at a main body side is fixed to an inner wall surface of a refrigerator or an inner surface of general furniture, and a moving rail at a drawer side is fixed to a storage body. Accordingly, the moving rail slides along the fixed rail, and thus the drawer is easily withdrawn and inserted.

However, in the case of the conventional bi-fold type sliding device, when the storage body is fixed to the moving rail and a weight is applied to the storage body, the moving rail tends to move and tilt with respect to the fixed rail due to the weight thereof, and thus there is a problem of degrading operability of the sliding device.

RELATED ART (Patent Document 1) US Patent Publication No. 6132020 (Oct. 17, 2000)

Technical Problem

The present invention is intended to address the above-described problems of the conventional technique and directed to providing a sliding device having a two-stage rail structure and improved tilting safety against a load.

Technical Solution

In order to achieve the above purpose, one aspect of the present invention provides a sliding device including a first rail member of which one side surface is open, a second rail member which slidably move on the first rail member and of which one side surface is open, and ball members disposed between the first rail member and the second rail member and including at least three ball members provided on a cross section of the sliding device, wherein the first rail member and the second rail member are engaged with each other through the open one side surfaces.

The first rail member may include a first upper portion, a first side portion connected to the first upper portion, and a first lower portion connected to the first side portion, the second rail member may include a second upper portion, a second side portion connected to the second upper portion, and a second lower portion connected to the second side portion, the first upper portion may be positioned between the second upper portion and the second lower portion, and the second lower portion may be positioned between the first upper portion and the first lower portion.

A first ball may be disposed between the first upper portion and the second upper portion, a second ball may be disposed between the first lower portion and the second lower portion, and an angle (θ) formed by a line (a), which connects centers of the first ball and the second ball, and the first lower portion or the second upper portion may be an acute angle.

A first insertion part which is inserted into the second rail member and on which the first ball is seated may be formed at an end of the first upper portion.

The first insertion part may include a first support obliquely formed at the end of the first upper portion, a first curved portion formed to extend from the first support and be bent outward, and a first seating part which extends from the first curved portion and on which the first ball is seated.

A second insertion part, which is inserted into the first rail member and on which the second ball is seated, may be formed at an end of the second lower portion.

The second insertion part may include a second support obliquely formed at the end of the second lower portion, a second curved portion formed to extend from the second support and be bent outward, and a second seating part which extends from the second curved portion and on which the second ball is seated.

A predetermined gap may be formed between the first upper portion and the first seating part.

A predetermined gap may be formed between the second lower portion and the second seating part.

A third ball may be disposed between a connection surface, which connects the second lower portion and the second side portion, and the first support.

A fourth ball may be disposed between a connection surface, which connects the first upper portion and the first side portion, and the second support.

The sliding device may further include a retainer disposed between the first rail member and the second rail member and including a plurality of ball grip parts formed to be spaced apart from each other.

The retainer may be formed in an "S" shape.

A cross section of the retainer may be formed with a structure rotationally symmetrical at 180° about a center (G).

The first rail member and the second rail member may be disposed complementary to each other through the open one side surfaces.

The first insertion part may have a cross section, of which an outline is formed as a closed loop line, and be formed as one part of which an inside is fully filled, and track grooves which come into contact with the ball members may be formed at at least one of two corners of the first insertion part facing each other.

The second insertion part may have a cross section, of which an outline is formed as a closed loop line, and be formed as one part of which an inside is fully filled, and track grooves which come into contact with the ball members may be formed at at least one of two corners of the second insertion part facing each other.

Advantageous Effects

According to one aspect of the present invention, a rail which stably supports a load and also has a simple structure can be provided.

In addition, a resistance force against a torsional load applied to a sliding device due to a weight of a drawer body and a weight of a stored object can be improved.

Effects of the present invention are not limited to the above-described effects and should be understood that the effects of the present invention include any effect which may be inferred from the configuration of the invention described in the detailed description and the claims of the present invention.

MODES OF THE INVENTION

Figure 1:
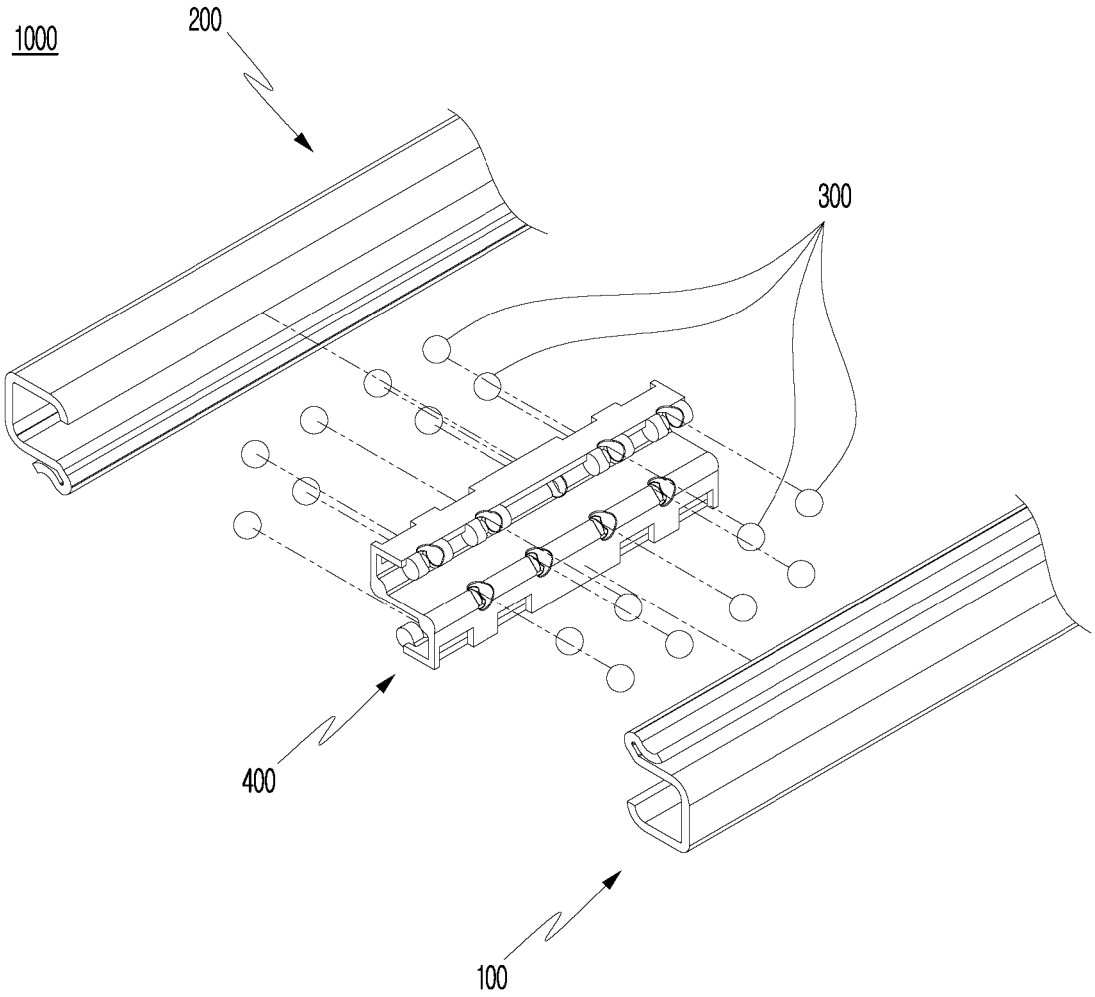
FIG. 1 is a perspective view illustrating a sliding device according to one embodiment of the present invention.

Hereinafter, the present invention will be described in detail with reference to the accompanying drawings. However, embodiments of the present invention may be implemented in several different forms and are not limited to embodiments described herein. In addition, parts irrelevant to the description are omitted in the drawings in order to clearly explain embodiments of the present invention. Similar parts are denoted by similar reference numerals throughout this specification.

Throughout this specification, when a part is referred to as being "connected" to another part, it includes being "directly connected" and "indirectly connected" via an intervening part. Also, when a certain part "includes" a certain component, this does not exclude other components unless explicitly described otherwise, and other components may be further included.

Throughout this specification, directional terms such as "upper," "side," and "lower" are only to describe relative positional relationships between components illustrated in the accompanying drawings and do not define absolute positions of the components.

Hereinafter, embodiments of the present invention will be described in detail with reference to the accompanying drawings.

Figure 2:
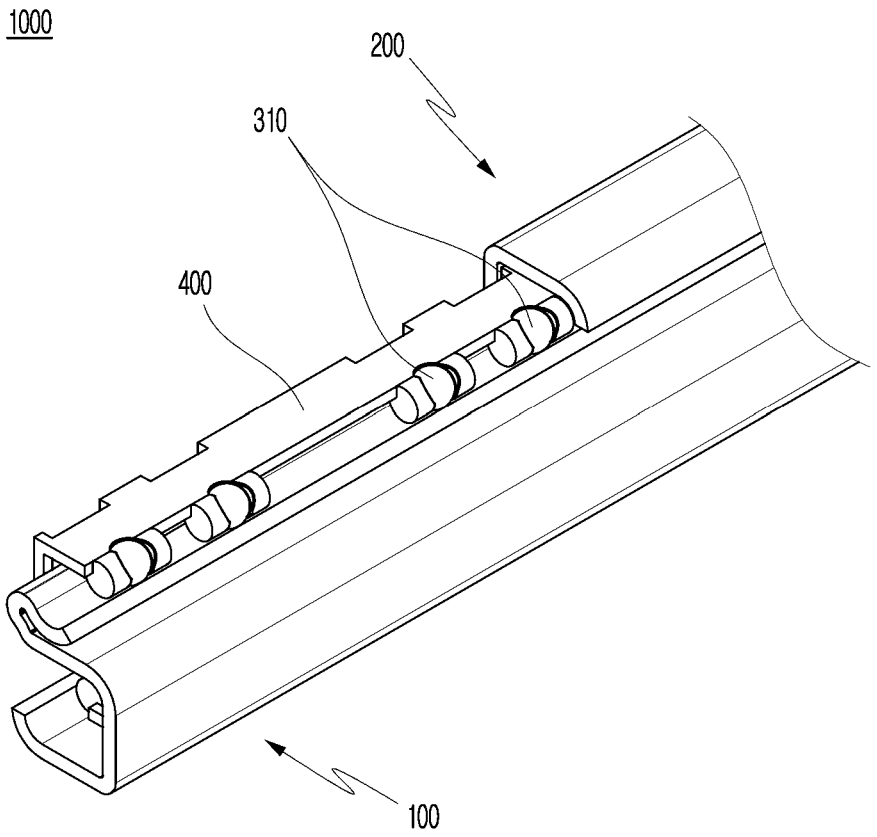
FIG. 2 is an exploded perspective view illustrating the sliding device according to one embodiment of the present invention.
Figure 3:
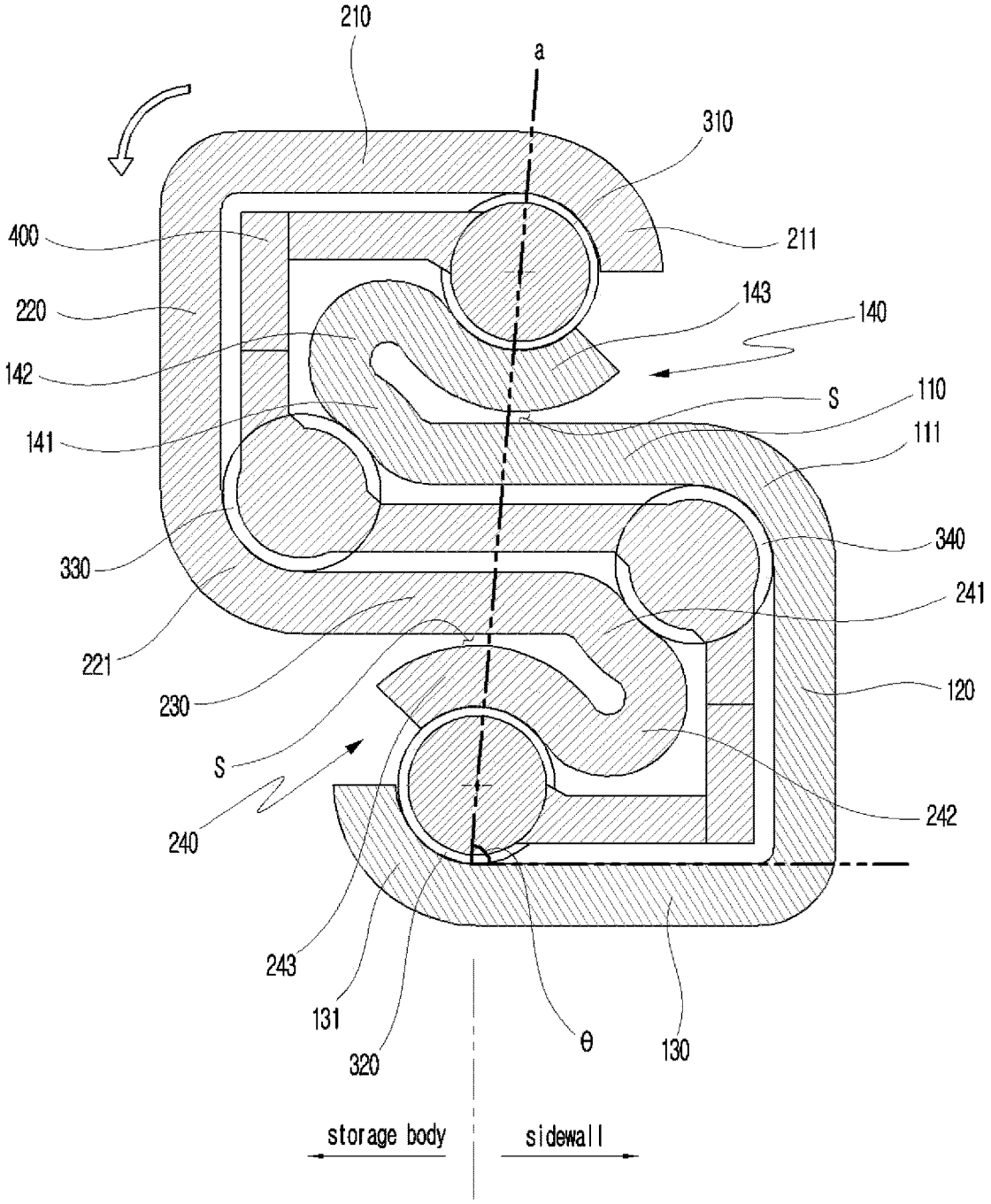
FIG. 3 is a cross-sectional view illustrating the sliding device according to one embodiment of the present invention.
Figure 4:
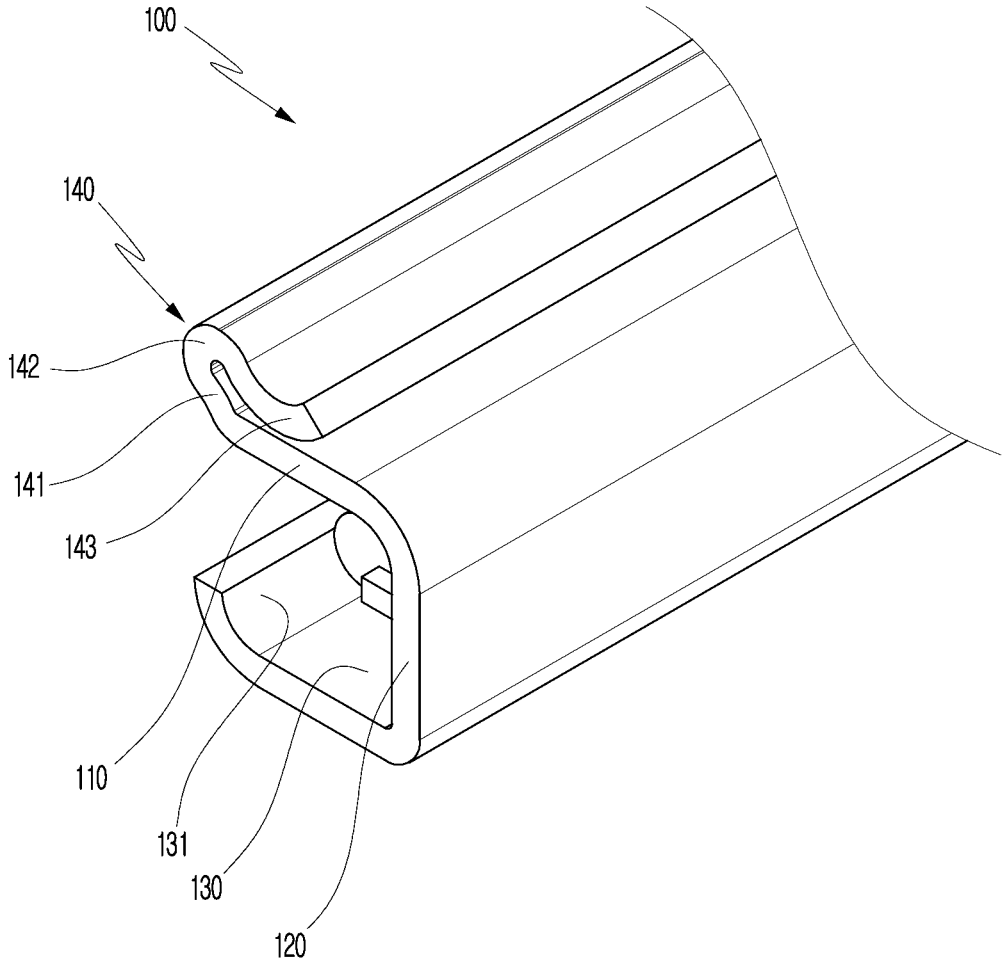
FIG. 4 is a perspective view illustrating a first rail member according to one embodiment of the present invention.
Figure 5:
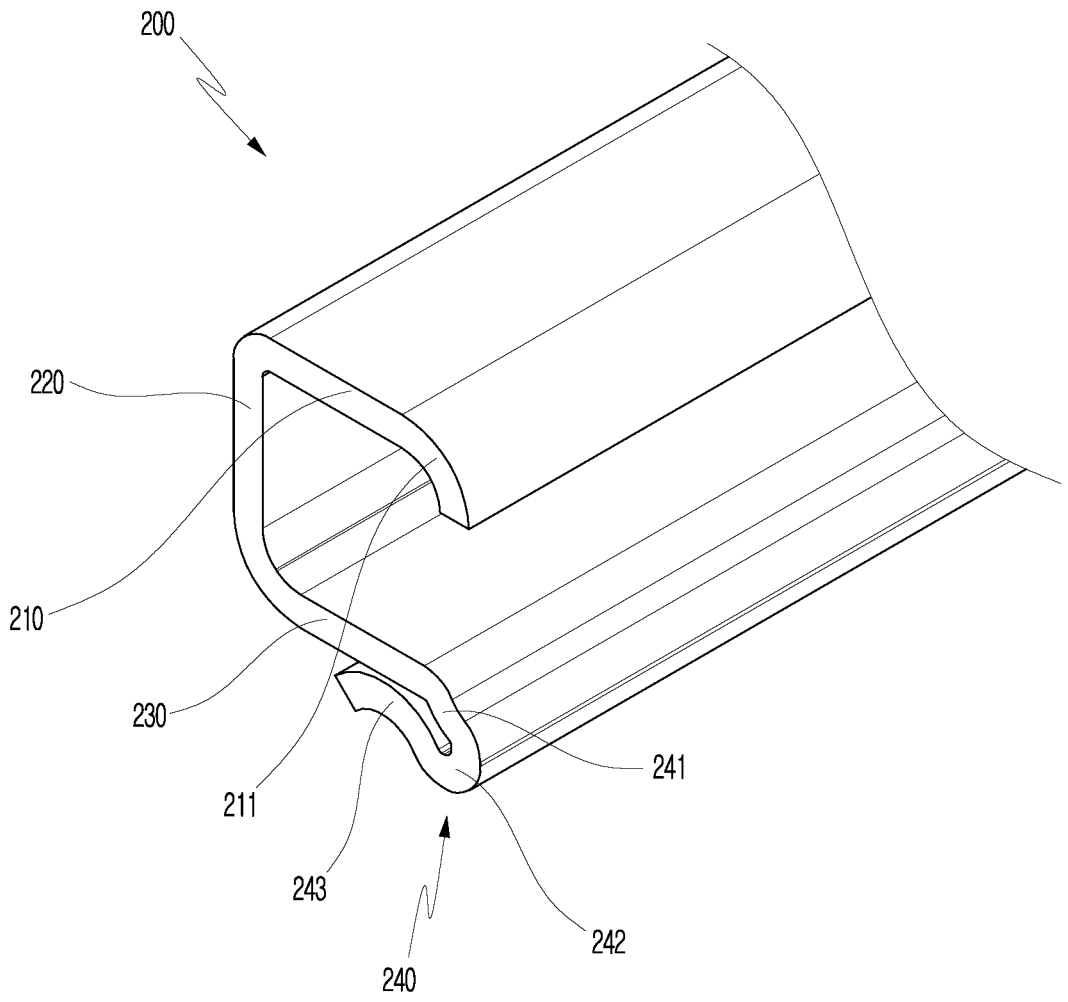
FIG. 5 is a perspective view illustrating a second rail member according to one embodiment of the present invention.

FIG. 1 is a perspective view illustrating a sliding device according to one embodiment of the present invention, FIG. 2 is an exploded perspective view illustrating the sliding device according to one embodiment of the present invention, and FIG. 3 is a cross-sectional view illustrating the sliding device according to one embodiment of the present invention. FIG. 4 is a perspective view illustrating a first rail member according to one embodiment of the present invention, and FIG. 5 is a perspective view illustrating a second rail member according to one embodiment of the present invention.

Referring to FIGS. 1 to 5, a sliding device 1000 of the present invention includes a first rail member 100, a second rail member 200, a plurality of ball members 300, and a retainer 400.

More specifically, the sliding device 1000 includes the first rail member 100, which is fixed to a sidewall of a mounting structure such as a drawer, a dishwasher, a refrigerator, or the like, and the second rail member 200 provided to be slidably moved on the first rail member 100. Accordingly, the sliding device 1000 is formed as a structure for storing or taking out an object while slidably moving the second rail member 200 to one side or the other according to a user's need.

In addition, the sliding device 1000 is configured to reduce a friction force between rails by installing a rolling means such as the ball members 300 between the first rail member 100 and the second rail member 200. Accordingly, the sliding device 1000 can slidably move more smoothly.

The first rail member 100 is a member fixed to a sidewall of the mounting structure of the drawer, the dishwasher, the refrigerator, or the like and has three surfaces, and one side surface of the first rail member 100 is open. The first rail member 100 may be formed in substantially a "c" shape.

The second rail member 200 is a member which slidably moves on the first rail member and has three surfaces, and one side surface of the second rail member 200 is open. The second rail member 200 may be formed in substantially a "c" shape.

The first rail member 100 and the second rail member 200 are complementarily disposed to engage with each other through the open one side surfaces. In this case, the first rail member 100 and the second rail member 200 may have cross sections which are symmetrical to each other in a diagonal direction.

The ball members 300 are disposed between the first rail member 100 and the second rail member 200 and may be provided as at least three ball members 300 on a cross section.

The first rail member 100 includes a first upper portion 110, a first side portion 120 connected to the first upper portion 110, and a first lower portion 130 connected to the first side portion 120.

Similarly, the second rail member 200 includes a second upper portion 210, a second side portion 220 connected to the second upper portion 210, and a second lower portion 230 connected to the second side portion 220.

In this case, the first upper portion 110 is provided to be positioned between the second upper portion 210 and the second lower portion 230, and the second lower portion 230 is provided to be positioned between the first upper portion 110 and the first lower portion 130.

Accordingly, the first rail member 100 and the second rail member 200 are disposed to be engaged with each other to be mutually restricted.

Referring to FIG. 3, a first ball 310 is disposed between the first upper portion 110 and the second upper portion 210, and a second ball 320 is disposed between the first lower portion 130 and the second lower portion 230.

A first reinforcing part 131 bent inward may be formed at an end of the first lower portion 130 to form a second race way and prevent separation of the second ball 320.

In addition, a second reinforcing part 211 bent inward may be formed at an end of the second upper portion 210 to form a first race way and prevent separation of the first ball 310.

In this case, a line a, which connects centers of the first ball 310 and the second ball 320, may be provided to be inclined at a predetermined angle with respect to the first lower portion 130 of the first rail member 100 or the second upper portion 210.

More specifically, an angle θ formed by the line a, which connects the centers of the first ball 310 and the second ball 320, and the first lower portion 130 or the second upper portion 210 may be an acute angle, a right angle, or an obtuse angle.

Preferably, the angle θ formed by the line a, which connects the centers of the first ball 310 and the second ball 320, and the first lower portion 130 or the second upper portion 210 may be an acute angle. This is to increase a resistance force against a torsional load applied to the sliding device 1000 due to a weight of a drawer body and a weight of a stored object.

That is, by forming the angle θ as the acute angle, the sliding device 1000 having a high resistance force against a vertical load and a torsional load due to the drawer body fixed to the second rail member 200 and the stored object can be provided.

Meanwhile, a first insertion part 140, which is disposed to be inserted into the second rail member 200 and on which the first ball 310 is seated, may be formed at an end of the first upper portion 110 of the first rail member 100. In this case, the first insertion part 140 may be formed in a shape bent outward.

More specifically, the first insertion part 140 may include a first support 141 formed to be inclined upward from the end of the first upper portion 110, a first curved portion 142 formed to extend from the first support 141 and be bent outward, and a first seating part 143 which extends from the first curved portion 142 and on which the first ball 310 is seated.

Similarly, a second insertion part 240, which is inserted into the first rail member 100 and on which the second ball 320 is seated, may be formed at an end of the second lower portion 230 of the second rail member 200. In this case, the second insertion part 240 may be formed in a shape bent outward.

More specifically, the second insertion part 240 may include a second support 241 formed to be inclined downward from the end of the second lower portion 230, a second curved portion 242 formed to extend from the second support 241 and be bent outward, and a second seating part 243 which extends from the second curved portion 242 and on which the second ball 320 is seated.

Since the first insertion part 140 and the second insertion part 240 are formed on the first rail member 100 and the second rail member 200, respectively, the ball members 300 can perform rolling movement more stably between the first rail member 100 and the second rail member 200.

Meanwhile, a predetermined gap S may be formed between the first upper portion 110 and the first seating part 143 of the first rail member 100, and a predetermined gap S may be formed between the second lower portion 230 and the second seating part 243 of the second rail member 200.

Since the predetermined spaces are vertically formed as described above, the sliding device 1000 can partially absorb vertical movement when the sliding device 1000 operates, and thus the sliding device 1000 can smoothly operate even under a high load.

Figure 7:
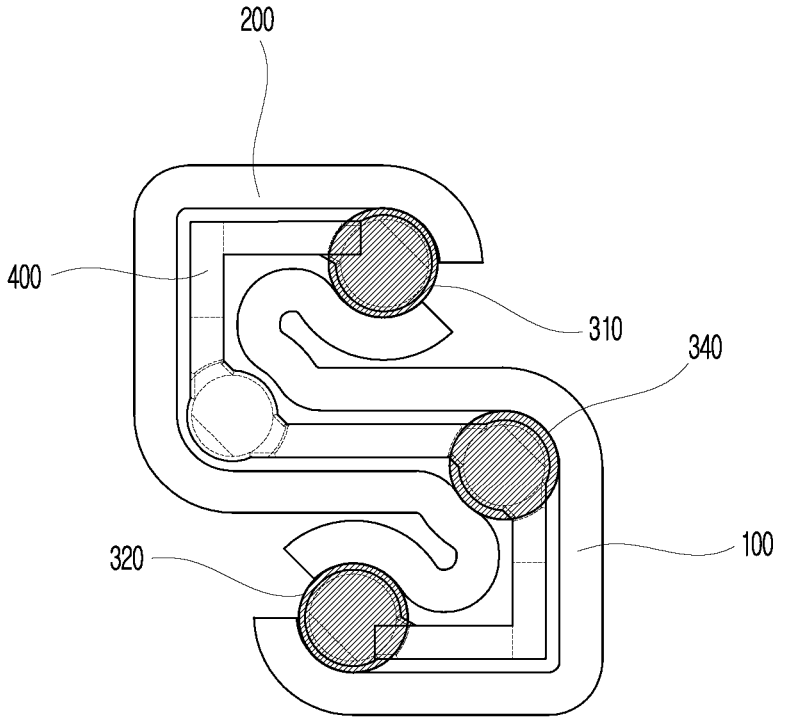
FIG. 7 is a set of cross-sectional views illustrating a three-ball type slide device according to one embodiment of the present invention.
Figure 7:
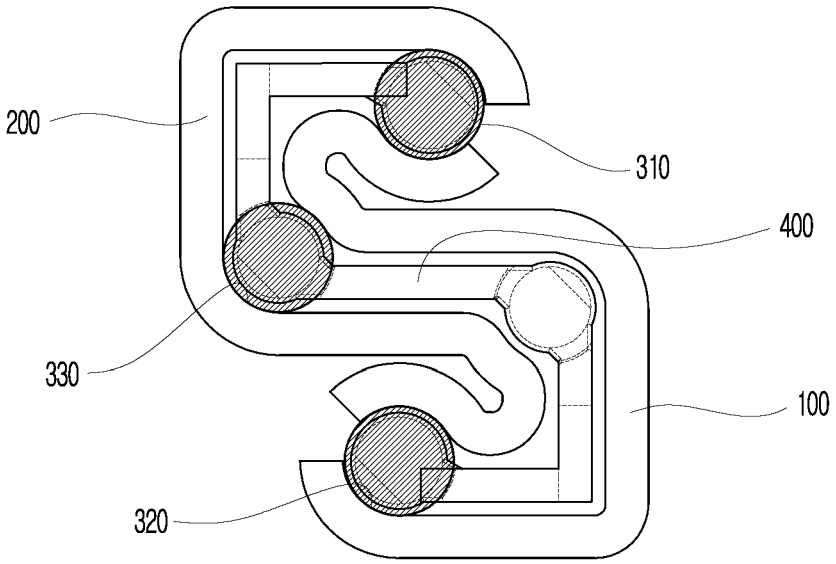

FIG. 7 is a set of cross-sectional views illustrating a three-ball type sliding device according to one embodiment of the present invention.

Referring to FIGS. 3 and 7, a third race way is formed between a connection surface 221, which connects the second lower portion 230 and the second side portion 220, and the first support 141, and a third ball 330 may be disposed on the third race way.

In addition, a fourth race way is formed between a connection surface 111, which connects the first upper portion 110 and the first side portion 120, and the second support 241, and a fourth ball 340 may be disposed on the fourth race way.

In this case, any one of the third ball 330 and the fourth ball 340 may be omitted. Accordingly, the sliding device 1000 may be used as a three-ball type or a four-ball type sliding device 1000 as necessary.

Figure 6:
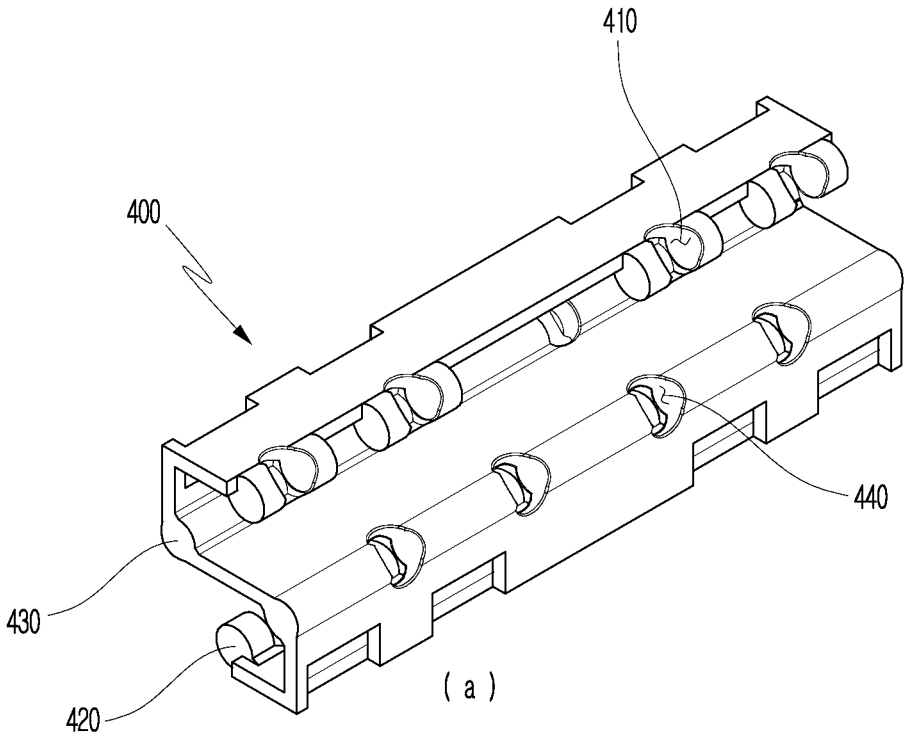
FIG. 6 is a set of perspective views illustrating a retainer according to one embodiment of the present invention.
Figure 6:
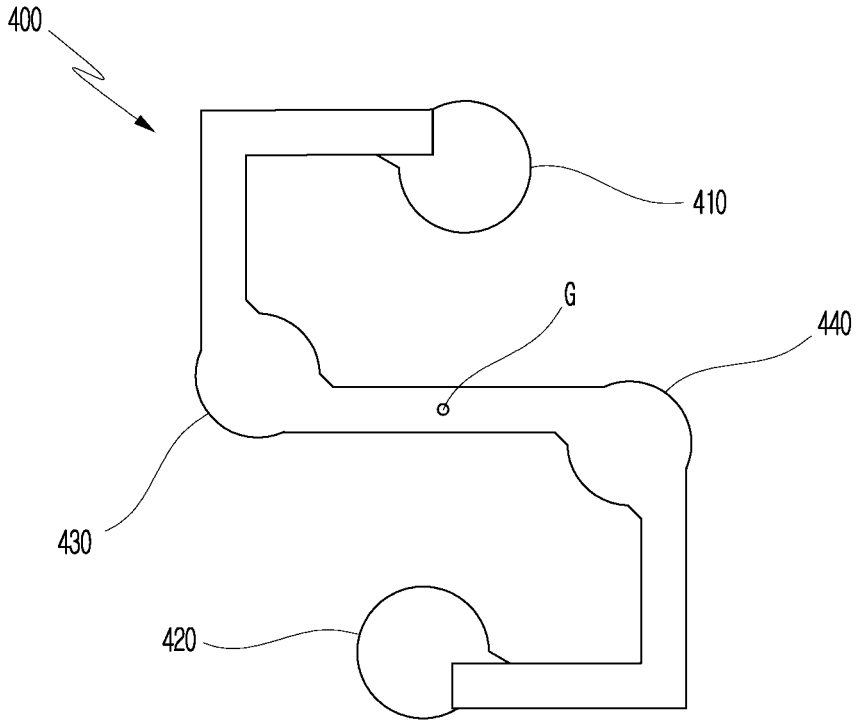

FIG. 6 is a set of perspective views illustrating a retainer according to one embodiment of the present invention.

Referring to FIG. 6, the sliding device 1000 may further include the retainer 400 disposed between the first rail member 100 and the second rail member 200. In this case, the retainer 400 may be formed in substantially an "S" shape.

The retainer 400 includes a ball grip part into which the ball member 300 is inserted. The ball grip part may include a first grip portion 410 into which the first ball is inserted, a second grip part 420 into which the second ball is inserted, a third grip part 430 into which the third ball is inserted, and a fourth grip part 440 into which the fourth ball is inserted. The plurality of ball grip portions 410, 420, 430, and 440 may be formed to be spaced apart from each other in a longitudinal direction of the retainer 400.

The retainer 400 serves to hold the ball members 300 so that the ball members 300 roll to move along the race ways of the first rail member 100 and the second rail member 200.

A cross section of the retainer 400 may be formed with a structure rotationally symmetrical at 180° with respect to a center G.

Stoppers, which prevent the retainer 400 from being separated from the sliding device 1000, for example, protrusions protruding toward the insides of the rails, may be formed in front of and behind the first rail member 100 and the second rail member 200. Since such formation of the stoppers is naturally necessary for smooth sliding operation, and the stoppers may have proper shapes and may be properly positioned by those skilled in the art, the stoppers are omitted in the accompanying drawings for describing the present invention for the sake of convenience.

Figure 8:
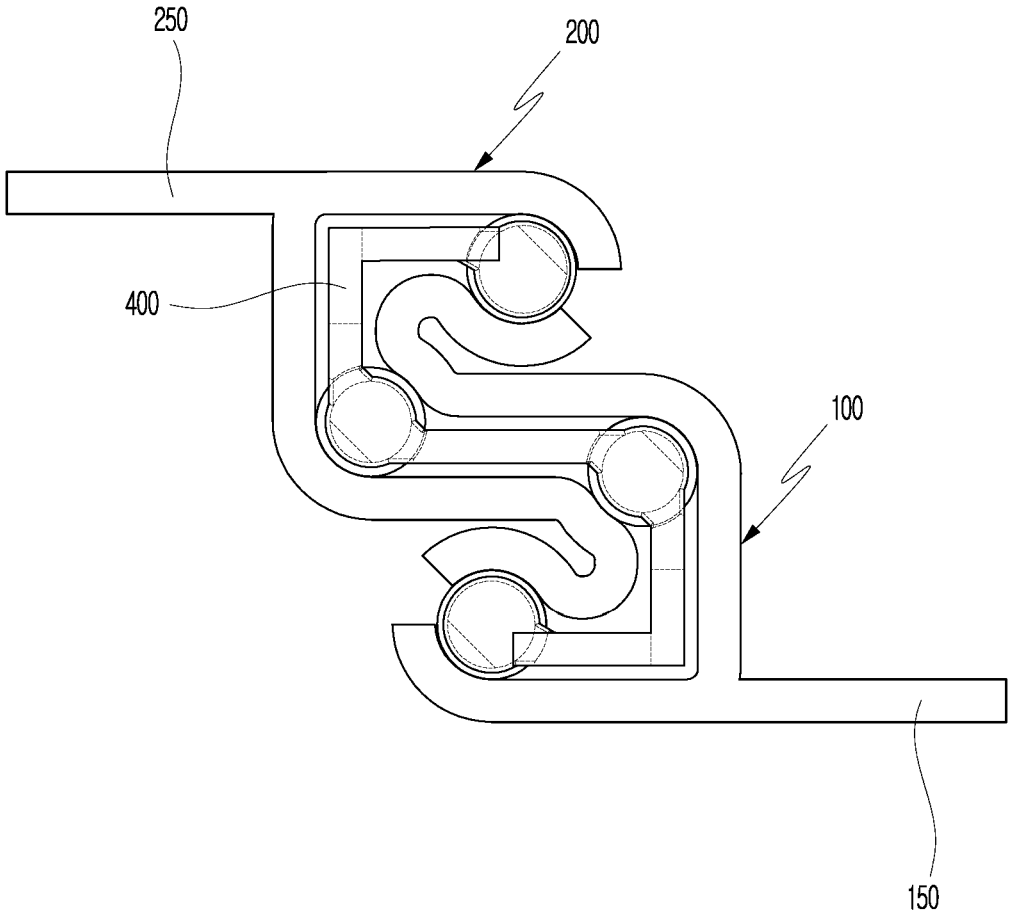
FIG. 8 is a cross-sectional view illustrating a sliding device according to a second embodiment of the present invention.

FIG. 8 is a cross-sectional view illustrating a sliding device according to a second embodiment of the present invention.

Another example of the sliding device according to the present invention is illustrated in FIG. 8. In this case, the same reference numerals refer to the same members of the above-described sliding device 1000.

Since a sliding device 1000 of the present invention is symmetrically formed, when one member of two members 100 and 200 is fixed to a lower surface of a drawer plate and used as a moving member, the other member serves as a fixed member fixed to a sidewall of a main body of a desk, a cabinet, or the like.

Referring to FIG. 8, a first fixed part 150, which is integrally formed with a first rail member 100 and fixed to the sidewall of the main body, may be formed at one side of the first rail member 100. The first fixed part 150 serves to fix the sliding device 1000 to a sidewall plate of the main body such as the desk, the cabinet, or the like.

Similarly, a second fixed part 250, which is integrally formed with a second rail member 200 and fixed to a storage body, may be formed at one side of the second rail member 200. The second fixed part 250 serves to fix the sliding device 1000 to the storage body such as a basket.

Figure 9:
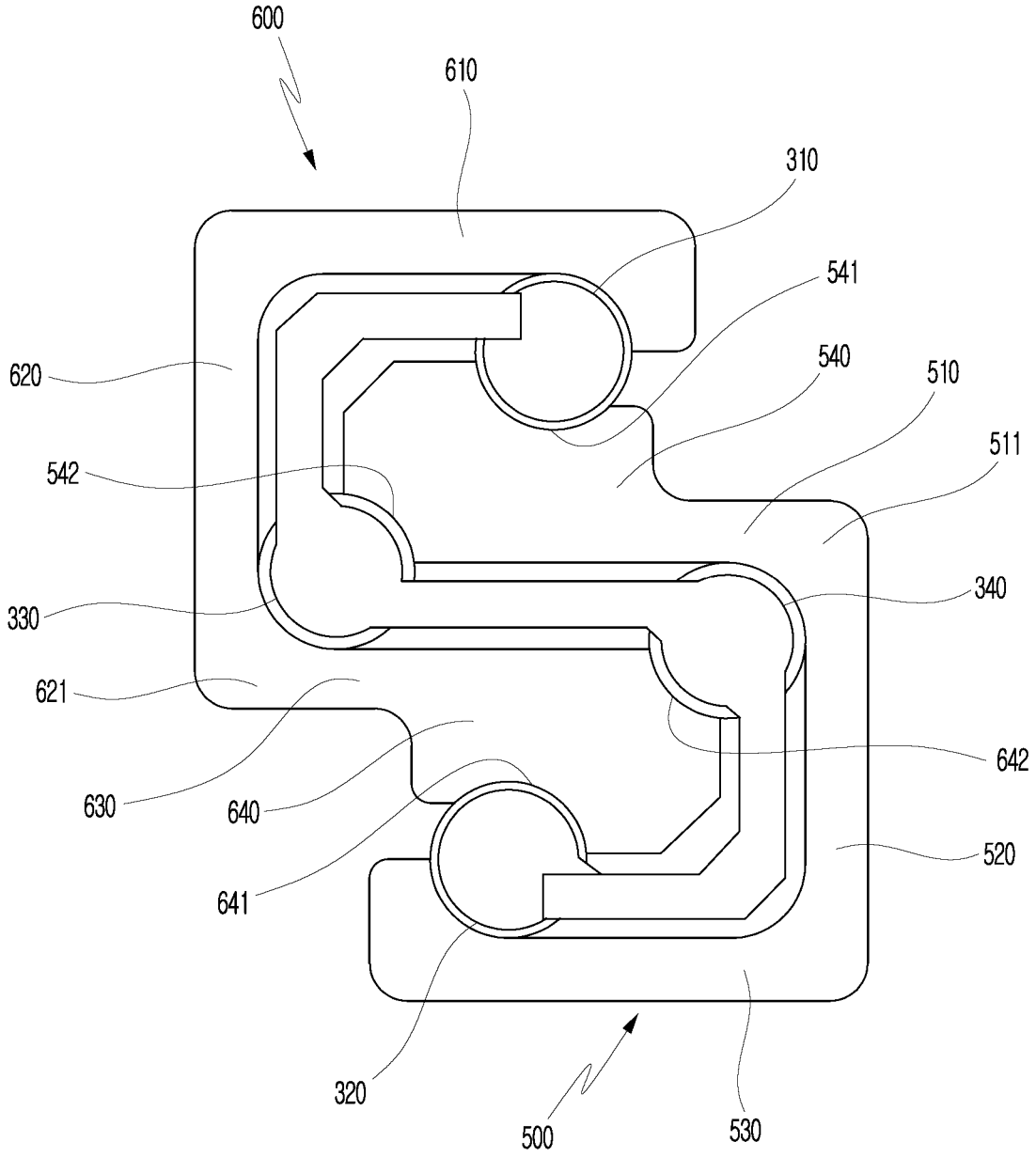
FIG. 9 is a cross-sectional view illustrating a sliding device according to a third embodiment of the present invention.
Figure 10:
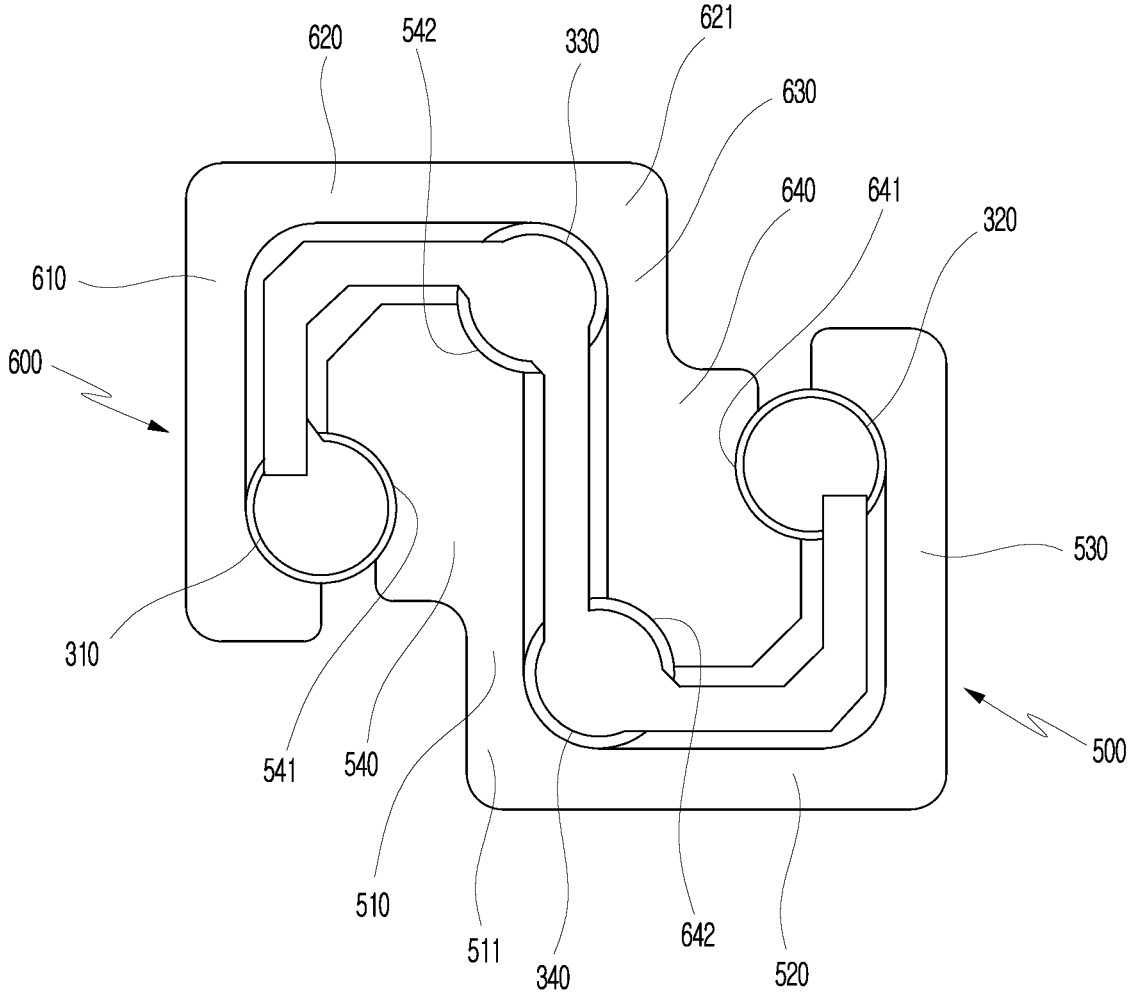
FIG. 10 is a cross-sectional view illustrating a state of a sliding device rotated at 90 degrees according to a fourth embodiment of the present invention.

FIG. 9 is a cross-sectional view illustrating a sliding device according to a third embodiment of the present invention, and FIG. 10 is a cross-sectional view illustrating a state of a sliding device rotated at 90 degrees according to a fourth embodiment of the present invention.

Hereinafter, differences from the above-described one embodiment will be mainly described with reference to FIG. 9.

A first insertion part 540, which is inserted into a second rail member 600 and on which a first ball 310 is seated, may be formed at an end of a first upper portion 510 of a first rail member 500.

In this case, the first insertion part 540 may have a cross section, of which an outline is formed as a closed loop line, and be formed as one part of which the inside is fully filled, and track grooves 541 and 542 which come into contact with ball members 300 may be formed at at least one of two corners of the first insertion part 540 facing each other.

That is, the first insertion part 540 may be formed in a shape of which the cross section is thicker than each of the first upper portion 510, a first side portion 520, and a first lower portion 530, and thus the first insertion part 540 can more easily support a load applied to the sliding device 1000.

Similarly, a second insertion part 640, which is inserted into the first rail member 500 and on which a second ball 320 is seated, may be formed at an end of a second lower portion 630 of the second rail member 600.

In this case, the second insertion part 640 may have a cross section, of which an outline is formed as a closed loop line, and be formed as one part of which the inside is fully filled, and track grooves 641 and 642 which come into contact with ball members 300 may be formed at at least one of two corners of the second insertion part 640 facing each other.

That is, the second insertion part 640 may be formed in a shape, of which a cross section is thicker than each of a second upper portion 610, a second side portion 620, and the second lower portion 630, and thus the second insertion part 640 can more easily support the load applied to the sliding device 1000.

Meanwhile, referring to FIG. 10, a user may rotate a sliding device 1000 of the present invention 90 degrees and use the sliding device 1000 as necessary. More specifically, in a drawer structure of a refrigerator or automobile, since the sliding device 1000 is rotated 90 degrees and used, an overall height occupied by the sliding device 1000 is reduced in a space, and thus spatial efficiency can be improved.

Figure 11:
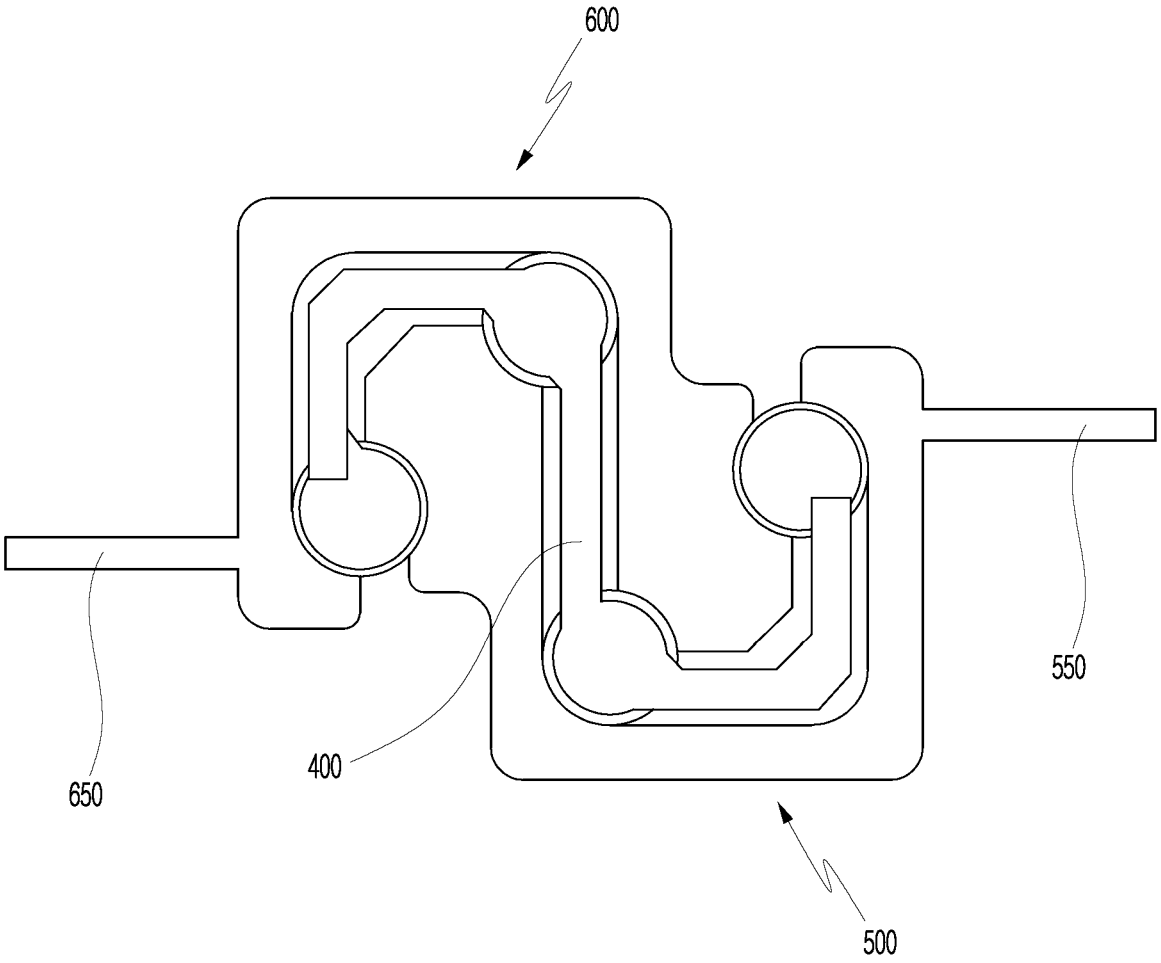
FIG. 11 is a cross-sectional view illustrating a sliding device according to a fifth embodiment of the present invention.

FIG. 11 is a cross-sectional view illustrating a sliding device according to a fifth embodiment of the present invention.

Referring to FIG. 11, a first fixed part 550, which is integrally formed with a first rail member 500 and fixed to a sidewall of a main body, may be formed at one side of the first rail member 500. The first fixed part 550 serves to fix a sliding device 1000 to a sidewall plate of the main body such as a desk, a cabinet, or the like.

Similarly, a second fixed part 650, which is integrally formed with a second rail member 600 and fixed to a storage body, may be formed at one side of the second rail member 600. The second fixed part 650 serves to fix the sliding device 1000 to the storage body such as a basket.

The above description is only exemplary and may be understood by those skilled in the art that the invention may be easily changed into other concrete forms without changing the technological spirit and essential features. Therefore, the above-described embodiments should be considered as only examples in all aspects and not for purposes of limitation. For example, each component described as a single type may be implemented in a distributed manner, and similarly, components that are described as being distributed may be implemented in a coupled manner.

The scope of the present invention is defined by the appended claims and encompasses all modifications or alterations derived from meanings, the scope, and equivalents of the appended claims.

REFERENCE NUMERALS

1000: SLIDING DEVICE
100, 500: FIRST RAIL MEMBER
110, 510: FIRST UPPER PORTION
120, 520: FIRST SIDE PORTION
130, 530: FIRST LOWER PORTION
140, 540: FIRST INSERTION PART
150, 550: FIRST FIXED PART
200, 600: SECOND RAIL MEMBER
210, 610: SECOND UPPER PORTION
220, 620: SECOND SIDE PORTION
230, 630: SECOND LOWER PORTION
240, 640: SECOND INSERTION PART
250, 650: SECOND FIXED PART
300: BALL MEMBER
310: FIRST BALL
320: SECOND BALL
330: THIRD BALL
340: FOURTH BALL
400: RETAINER
410: FIRST GRIP PORTION
420: SECOND GRIP PART
430: THIRD GRIP PART

440: FOURTH GRIP PART

The invention claimed is:

1. A sliding device comprising:

a first rail member of which one side surface is open;

a second rail member which slidably moves on the first rail member and of which one side surface is open; and ball members disposed between the first rail member and the second rail member and including at least three said ball members provided on a cross section of the sliding device, wherein the first rail member and the second rail member are engaged with each other through the open one side surfaces, wherein:

the first rail member includes a first upper portion, a first side portion connected to the first upper portion, a first lower portion connected to the first side portion, and a first insertion part which is inserted into the second rail member, and is formed at an end of the first upper portion;

the second rail member includes a second upper portion, a second side portion connected to the second upper portion, a second lower portion connected to the second side portion, and a second insertion part which is inserted into the first rail member, and is formed at an end of the second lower portion;

the first upper portion is positioned between the second upper portion and the second lower portion; and the second lower portion is positioned between the first upper portion and the first lower portion, wherein a first said ball member is disposed between the first upper portion and the second upper portion, and a second said ball member is disposed between the first lower portion and the second lower portion, wherein a third said ball member is disposed between the second lower portion and the first insertion part, and a fourth said ball member is disposed between the first upper portion and the second insertion part, wherein an acute angle is formed between a line connecting a center of the first ball member and a center of the fourth ball member and the first side portion, and an acute angle is formed between a line connecting a center of the second ball member and a center of the third ball member and the second side portion, and wherein when viewed in the cross section, a center of the first ball member and a center of the second ball member are disposed between a center of the third ball member and a center of the fourth ball member in a direction parallel to the first lower portion or the second upper portion.

2. The sliding device of claim 1, wherein:

an angle (θ) formed by a line (a), which connects centers of the first said ball member and the second said ball member, and the first lower portion or the second upper portion is an acute angle.

3. The sliding device of claim 1, wherein the first insertion part includes:

a first support obliquely formed at the end of the first upper portion;

a first curved portion formed to extend from the first support and be bent outward; and a first seating part which extends from the first curved portion and on which the first ball member is seated.

4. The sliding device of claim 3, wherein a predetermined gap is formed between the first upper portion and the first seating part.

5. The sliding device of claim 1, wherein the second insertion part includes:

a second support obliquely formed at the end of the second lower portion;

a second curved portion formed to extend from the second support and be bent outward; and a second seating part which extends from the second curved portion and on which the second ball member is seated.

6. The sliding device of claim 5, wherein a predetermined gap is formed between the second lower portion and the second seating part.

7. The sliding device of claim 1, further comprising a retainer disposed between the first rail member and the second rail member and including a plurality of ball grip parts formed to be spaced apart from each other.

8. The sliding device of claim 7, wherein the retainer is formed in an "S" shape.

9. The sliding device of claim 8, wherein a cross section of the retainer is formed with a structure rotationally symmetrical at 180° about a center (G).

10. The sliding device of claim 1, wherein the first rail member and the second rail member are disposed complementary to each other through the open one side surfaces.

11. The sliding device of claim 1, wherein:

the first insertion part has a cross section, of which an outline is formed as a closed loop line, and is formed as one part of which an inside is fully filled; and track grooves which come into contact with the ball members are formed at at least one of two corners of the first insertion part facing each other.

12. The sliding device of claim 1, wherein:

the second insertion part has a cross section, of which an outline is formed as a closed loop line, and is formed as one part of which an inside is fully filled; and track grooves which come into contact with the ball members are formed at at least one of two corners of the second insertion part facing each other.

* * * * *